US007083493B2

(12) United States Patent
Heo

(10) Patent No.: US 7,083,493 B2
(45) Date of Patent: Aug. 1, 2006

(54) YO-YO

(76) Inventor: Seok-Jin Heo, 103-601, Daewoo Marina Apt., 1388-4, U 1-Dong, Haeundae-Gu, Busan (KR)

( * ) Notice: Subject to any disclaimer, the term of this patent is extended or adjusted under 35 U.S.C. 154(b) by 0 days.

(21) Appl. No.: 11/105,349

(22) Filed: Apr. 14, 2005

(65) Prior Publication Data

US 2005/0233673 A1 Oct. 20, 2005

(30) Foreign Application Priority Data

Apr. 16, 2004 (KR) ..... 20-2004-0010578

(51) Int. Cl.
*A63H 1/30* (2006.01)
*A63B 67/10* (2006.01)
*A63F 9/02* (2006.01)

(52) U.S. Cl. ..... 446/250; 446/247; 473/506

(58) Field of Classification Search ..... 446/236, 446/247, 248, 250, 251, 255, 266; 273/329, 273/330; 473/506, 507
See application file for complete search history.

(56) References Cited

U.S. PATENT DOCUMENTS

| | | | | | |
|---|---|---|---|---|---|
| 1,322,217 | A | * | 11/1919 | Anderson | 446/250 |
| 1,527,532 | A | * | 2/1925 | Alcaraz | 473/506 |
| 1,923,019 | A | * | 8/1933 | De Silva | 446/250 |
| 1,942,719 | A | * | 1/1934 | Mikamo et al. | 473/507 |
| 2,579,022 | A | * | 12/1951 | Spencer et al. | 446/250 |
| 3,591,179 | A | * | 7/1971 | Pentek | 473/507 |
| 6,113,456 | A | * | 9/2000 | Hadzicki et al. | 446/250 |

FOREIGN PATENT DOCUMENTS

| | | | |
|---|---|---|---|
| EP | 653228 | A1 * | 5/1995 |
| FR | 2623416 | A1 * | 5/1989 |

* cited by examiner

*Primary Examiner*—Stephen Blau
*Assistant Examiner*—Alyssa Lowen
(74) *Attorney, Agent, or Firm*—Birch, Stewart, Kolasch & Birch, LLP

(57) ABSTRACT

A toy-type device which is adapted for both yo-yo play and ball-catching play utilizing a ball tethered to a disc-shaped body, wherein the ball can be used as a grasping element when the device is used as a yo-yo or alternatively the ball can be used as a free-body adapted to be caught by the disc-shaped body.

3 Claims, 4 Drawing Sheets

YO-YO

BACKGROUND OF THE INVENTION

1. Field of the Invention

The present invention relates to a yo-yo, and more particularly, to a yo-yo which simultaneously provides a player with yo-yo play and ball-catching play.

2. Background of the Related Art

In general, a yo-yo is a toy which includes a fixed axle, a pair of disc-type bodies having an equal size axially fixed to both sides of the fixed axle in such a manner as to be spaced apart from each other at a predetermined interval, an elongated string connected at one end to the fixed axle and connected at the other free end to a gripping element, such as a slip knot. An uncut loop of the string is formed around the axle. For yo-yo play, a player ties the string's free end around his or her middle finger, grasps the bodies, and then throws it with a smooth motion in a state where the string is completely wound around the fixed axle. At this time, the axle spins within the loop, causing a gyroscopic effect to occur. When the player flicks his or her wrist as soon as the cord is completely unwound, the yo-yo goes up to return to its original position, while the string is again wound around the axle due to a repulsive force. The yo-yo has been widely used as one of amusement toys which children and adults all enjoy together, since it is not restricted in time and space.

Japanese Utility Model Laid-Open Publication No. Sho 53-149699 and Korean Utility Model Registration Application No. 1986-018185 which have been filed by the same inventor as the present invention, respectively disclose ball-catching toys for allowing a player to easily catch a ball connected via a cord on a plate type support. Such ball-catching toys together with the yo-yo have been widely used as representative amusement toys.

However, such conventional toys have several disadvantages in that it is difficult to arouse continuous interest in the individual toys since they are restricted in playing methods, and they increase the financial burden by requiring the player to buy them separately.

SUMMARY OF THE INVENTION

Accordingly, the present device has been made in view of the above problems occurring in the prior art, and it is an object of the present invention to provide a yo-yo which simultaneously provides a player with a yo-yo playing ability and a ball-catching, playing ability.

To achieve the above object, according to the present invention, there is provided a Yo-yo containing a fixed axle and a pair of disc-type bodies having an equal size, axially fixed to both sides of the fixed axle in such a manner as to be spaced apart from each other at a predetermined interval. Each of the bodies has at least one seating recess formed on the outer circumferential surface thereof in such manner that two seating recesses of the bodies can face each other symmetrically, for lightly seating the ball-type grip thereon the ball-type grip has an insertion hole centrally drilled at one side thereof and an elongated string is connected at one end to the fixed axle and at the other free end to the ball-type grip a hollow cylindrical grasping handle which is open at one end is adapted to cooperate with a protrusion bar formed integrally with the disc-type bodies. The protrusion bar extends outwardly in the longitudinal direction of the fixed axle to which the disc-type bodies are fixed. Thus one part of the protrusion bar is adapted to fit into the handle, and the other part of the protrusion bar which protrudes in the opposite direction is adapted to be inserted into the insertion hole.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
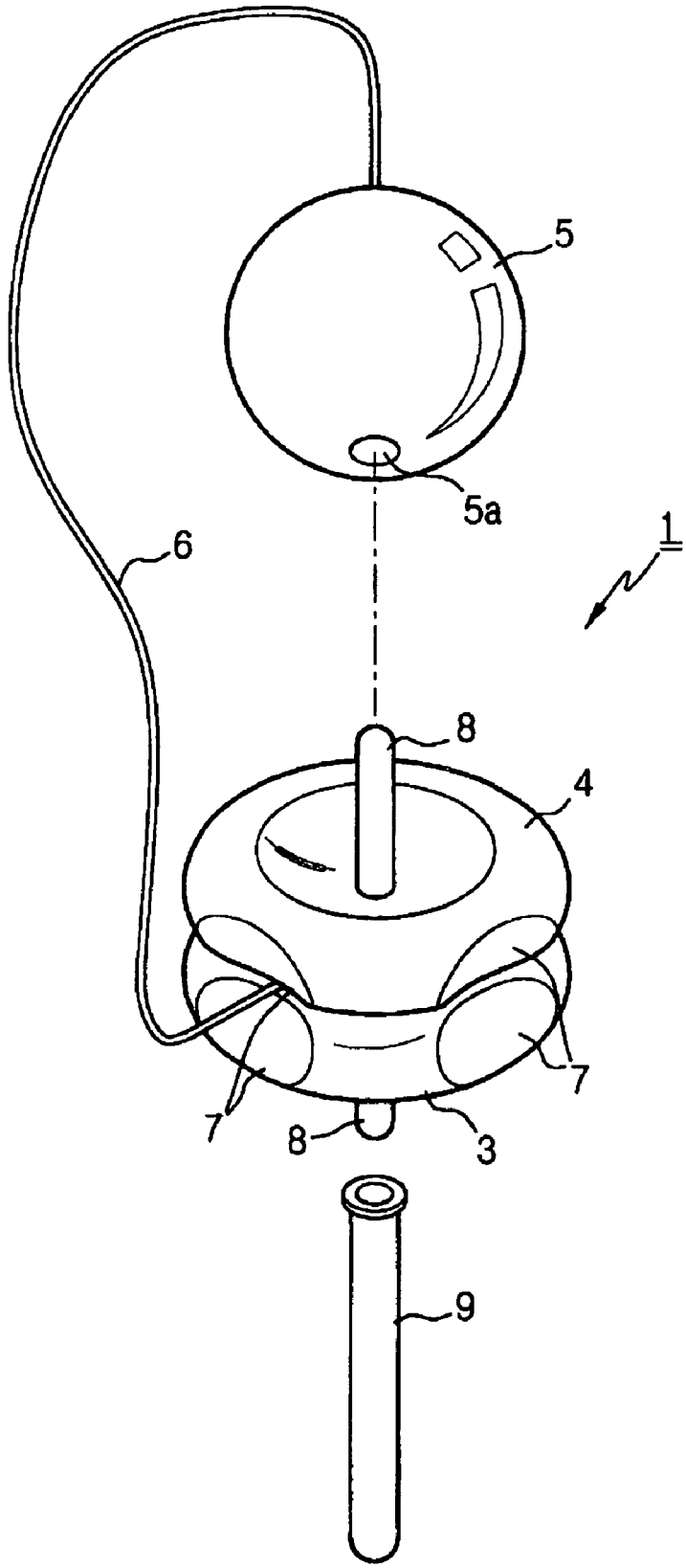
FIG. 1 is a perspective view of a preferred embodiment of the present invention.
Figure 2:
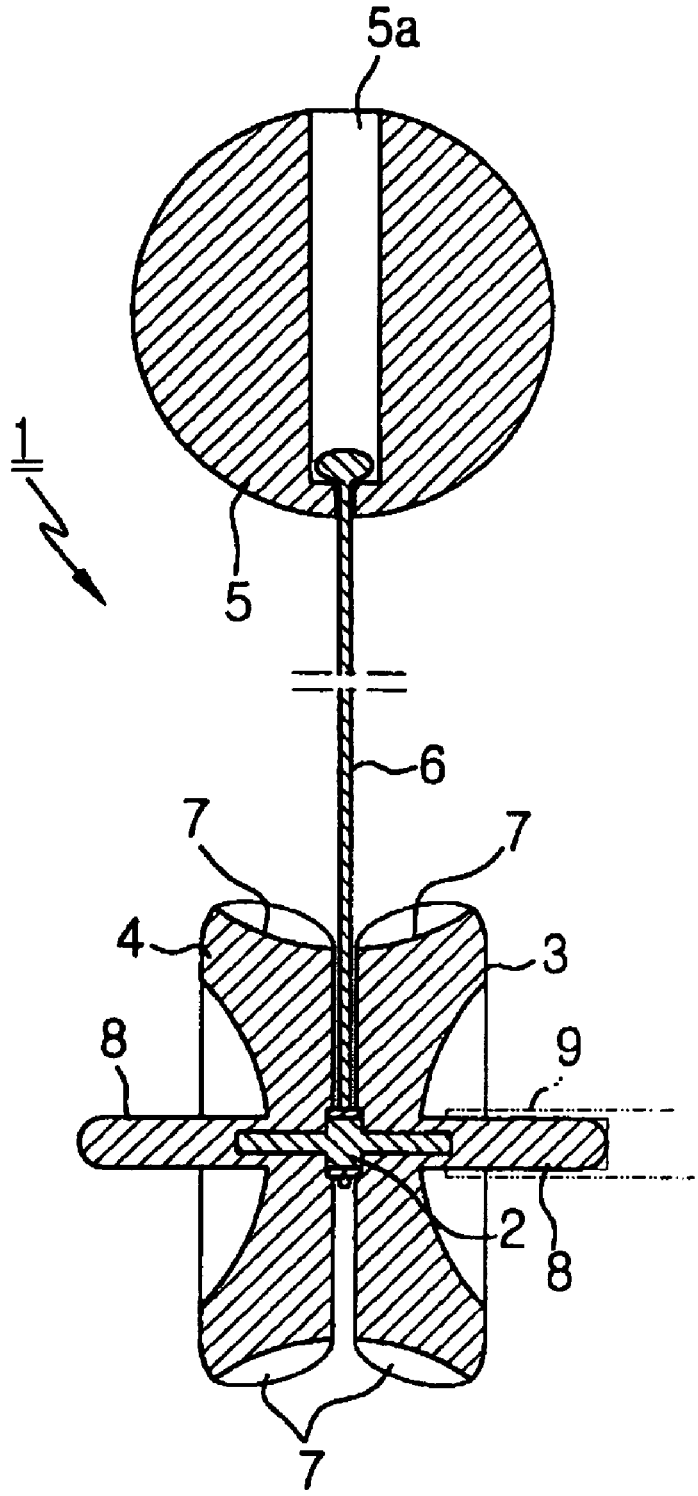
FIG. 2 is a sectional view of the present invention.
Figure 3:
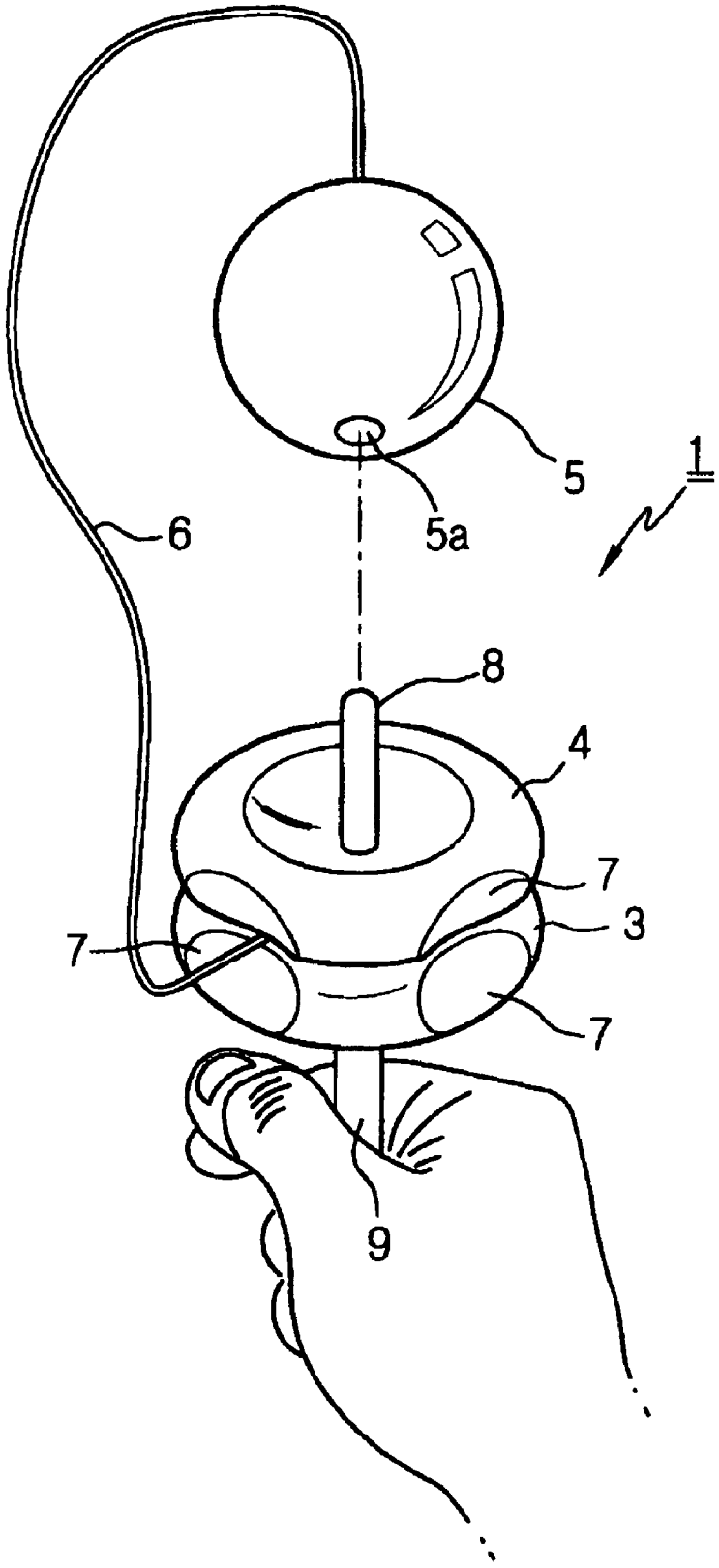
FIGS. 3 and 4 are views showing examples of a ball-catching play using the present invention.
Figure 4:
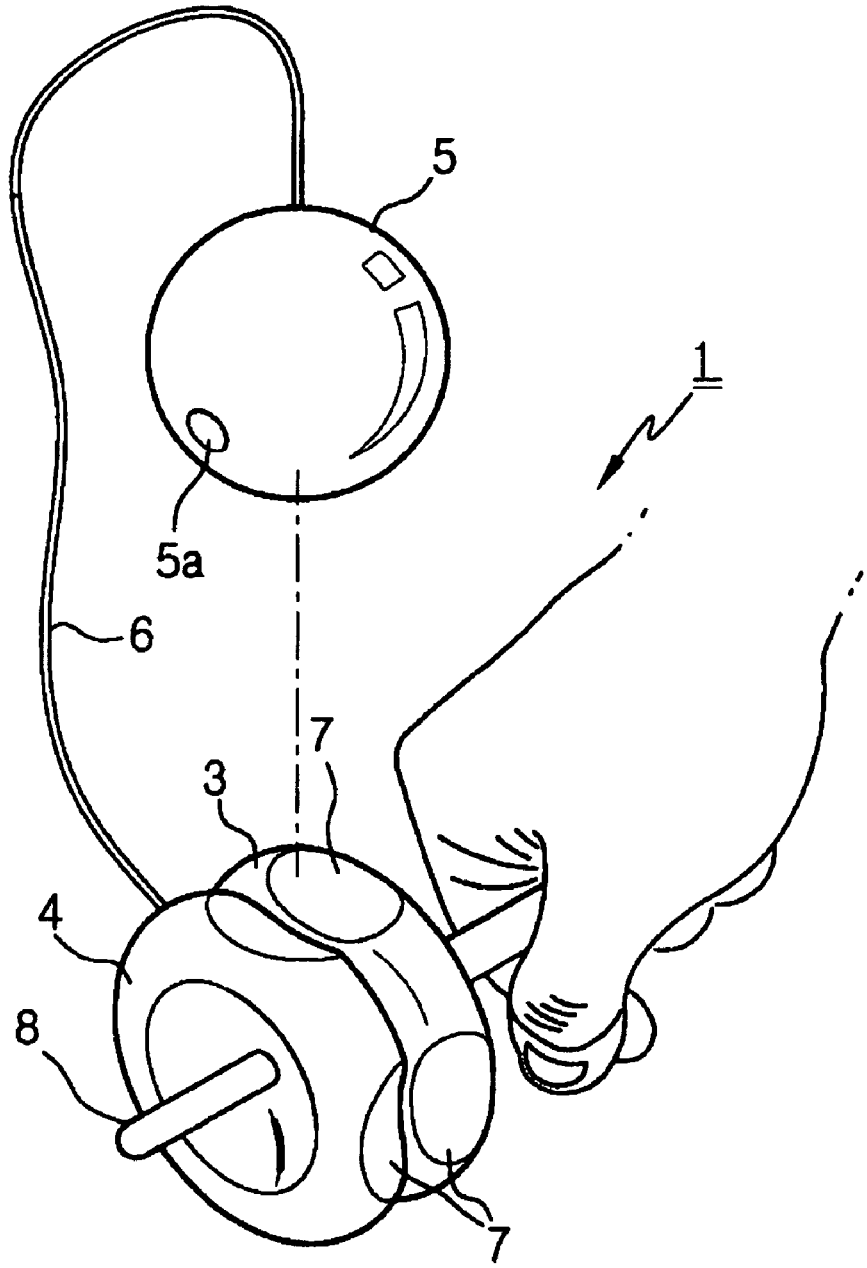

FIG. 1 is a perspective view of a preferred embodiment of the present invention, FIG. 2 is a sectional view of the present invention, and FIGS. 3 and 4 are views showing examples of a ball-catching play using the present invention.

As shown in the drawings, a yo-yo 1 includes a fixed axle 2, a pair of disc-type bodies 3 and 4 of equal size axially fixed on both sides of the fixed axle in such a manner as to be spaced apart from each other at a predetermined interval, a ball-type grip 5, and an elongated string 6 connected at one end to the fixed axle 2 and at the other free end to the ball-type grip 5. The present invention can also provide a player with a ball-catching play by improving the yo-yo 1.

The ball-type grip 5 is made of plastic or wood and has an insertion hole 5*a* centrally drilled at one side thereof. Each of the disc-type bodies 3 and 4 has at least one seating recess 7 formed on the outer circumferential surfaces thereof in such manner that the two seating recesses 7 of the bodies 3 and 4 face each other symmetrically, for lightly seating the ball-type grip 5 therein.

The present invention further includes a protrusion bar 8 formed integrally with the bodies 3 and 4 in such a manner as to be outwardly extended along the longitudinal direction of the fixed axle 2 to which the bodies 3 and 4 are fixed, and a cylindrical grasping handle 9 which is open at one end.

The grasping handle 9 is coupled to the protrusion bar 8 in such a manner as to be fit around one part of the protrusion bar 8. The other part of the protrusion bar 8 protruding in the opposite direction is adapted to be inserted into the insertion hole 5*a* of the ball-type grip 5 as shown in FIG. 3.

The yo-yo 1 of present invention having the above structure can allow a player to selectively enjoy yo-yoing or ball-catching, as desired.

That is, if the player wants to use the device as a yo-yo, like the conventional play method, the player grasps the ball-type grip 5 with his or her hand and throws the bodies 3 and 4 with a smooth motion in the state where the cord 6 is wound around the fixed axle 2. When the player flicks his or her wrist after the string 6 has been completely unwound, the yo-yo 1 then ascends toward his or her hand while the cord 6 is again wound around the fixed axle 2 due to a repulsive force.

If the player wants to use the device as a ball-catching play, the player first fits the handle 9 around the protrusion bar 8 protruding outwardly from one side of the body 3. As shown in FIGS. 3 and 4, the player grasps the handle 9 with his or her hand and throws the ball-type grip 5, which is connected to the cord 6, in the air, and then, attempts to catch the ball-type grip 5 either on the seating recesses 7 of the bodies 3 and 4 or fit the insertion hole 5*a* of the ball-type grip 5 onto the protrusion bar 8 which protrudes outwardly from one side of the body 4 in the opposite direction from the handle 9.

At this time, when the player receives the ball-type grip 5, if the ball-type grip 5 is not in soft contact with the seating recesses 7 of the bodies 3 and 4, the ball-type grip 5 is easily separated from the seating recesses 7 due to impact and elasticity. Accordingly, the player has to lower the bodies 3 and 4 a little bit in the downward direction with sensitivity as soon as the ball-type grip 5 becomes seated in the seating recesses 7 in order to relieve the impact and elasticity between the ball and the recess. Therefore, the present invention can provide the player with increased flexibility and interest during play.

As described above, in the yo-yo 1 according to the present invention, the seating recesses 7 are formed on the outer circumferential surfaces of the bodies 3 and 4, the protrusion bar 8 is formed in the longitudinal direction of the axle, and the insertion hole 5*a* is centrally drilled in one side of the ball-type grip 5. Alternative to yo-yo play, when a player wants to engage in ball-catching play, he or she must couple the handle 9 to the protrusion bar 8 protruding from the bodies 3 and 4. Thus, the present invention allows the player to simultaneously enjoy two types of play, thereby providing the player with flexibility and interest, and promoting development of motor skills since utilization of the device requires a player's quick action.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A toy type device which enables yo-yo play and ball-catching play which comprises:

a fixed axle;

a pair of disc-type bodies having an equal size and axially fixed to both sides of the fixed axle and spaced apart from each other at a predetermined distance, each of the disc-type bodies having at least one seating recess formed on the outer circumferential surfaces thereof in such manner that the seating recesses on each of the disc-type bodies face each other symmetrically to define a ball receiving recess;

a ball-type grip having an insertion hole centrally disposed in one side thereof;

an elongated string connected at one end to the fixed axle and at the other free end to the ball-type grip;

a protrusion bar formed integrally with the disc-type bodies so as to extend in opposite directions from said disc-type bodies along the longitudinal direction of the fixed axle to which the disc-type bodies are fixed; and a cylindrical grasping handle opened at one end and adapted to receive the protrusion bar, whereby one part of the protrusion bar is adapted to fit into the handle, and the other part of the protrusion bar, protruding in the opposite direction is adapted to be inserted into the insertion hole of the ball-type grip.

2. The protrusion bar extends from concave portions of the disc-type bodies, each concave portion being adapted to receive the ball-type grip.

3. The device of claim 1, wherein the ball receiving recesses are spaced from the longitudinal axis of the fixed axle.

* * * * *